US005145091A

United States Patent [19]

Meyers

[11] Patent Number: 5,145,091

[45] Date of Patent: Sep. 8, 1992

[54] RESEALABLE CONTAINER ASSEMBLY

[75] Inventor: George L. Meyers, Ashland, Ohio

[73] Assignee: The Garber Company, Ashland, Ohio

[21] Appl. No.: 776,840

[22] Filed: Oct. 15, 1991

[51] Int. Cl.[5] ..... B65H 1/00

[52] U.S. Cl. ..... 221/45; 221/46; 206/494; 206/812; 229/207; 229/229

[58] Field of Search ..... 221/45–48, 221/33, 49, 34, 282; 229/207, 223, 231, 237, 229; 206/494, 812

[56] References Cited

U.S. PATENT DOCUMENTS

| | | | |
|---|---|---|---|
| 3,258,156 | 6/1966 | Smith | 206/494 |
| 3,780,908 | 12/1973 | Fitzpatrick et al. | 206/494 |
| 4,131,195 | 12/1978 | Worrell | 206/812 |
| 4,790,436 | 12/1988 | Nakamura | 206/494 |
| 4,840,270 | 6/1989 | Caputo et al. | 206/812 |

*Primary Examiner*—H. Grant Skaggs
*Attorney, Agent, or Firm*—Fay, Sharpe, Beall, Fagan, Minnich & McKee

[57] ABSTRACT

A resealable dispensing container assembly for moist products comprises a first container of bag-like form constructed of liquid impervious flexible sheet material with the moist products sealed therein. The bag-like container has a weakened tear line encircling a first predetermined area on a first side thereof to permit selective removal of the predetermined area to define a discharge opening for removing moist products from the interior of the bag-like container. A removable flap member is adhered to the bag-like container in overlying and adhered relationship to the predetermined area such that pulling the flap from the bag-like container tears the first predetermined area therefrom to open the discharge opening. A second container of box-like form and constructed of relatively rigid sheet material encloses the bag-like container. The box-like container has a first wall closely overlying the first predetermined area of the bag-like container. The first wall has a weakened tear line encircling a second predetermined area thereof which overlies and is at least substantially as large as the first predetermined area in the side of the bag-like container. A relatively rigid cover is pivoted relative to the first wall and overlies a second predetermined area. The cover is bonded to the second predetermined area of the first wall such that pivoting of the cover causes the second predetermined area to be torn from the first wall to provide access to the first predetermined area of the bag-like container.

7 Claims, 3 Drawing Sheets

RESEALABLE CONTAINER ASSEMBLY

BACKGROUND OF THE INVENTION

The subject invention is directed to a resealable container assembly for moist products.

The invention is particularly suited for containing wet tissues and will be described with reference thereto; however, as will become apparent, the invention is capable of broader application and could be used for containing a variety of products which must be maintained in a moist or damp condition for a period of time after the container is opened.

Moist or wet tissues and fiber towels are commonly supplied as packaged stacks containing multiple individual towels which are consumed over a relatively extended period of time after the package is originally opened. Consequently, it is highly desirable that the packages be capable of being resealed to an extent sufficient to prevent undue drying of the unused tissues.

Molded plastic containers with snap-on covers or closures meet the general requirements and have been used with some commercial success in the marketing of such tissues. These molded containers are, however, relatively expensive and unduly add cost to what should be a relatively inexpensive product.

As alternatives to molded plastic containers, various flexible bags formed from plastic sheet have been used. Typically, these bag containers have been closed by flaps or tabs coated with pressure sensitive adhesive. Closure of the flaps or tabs is often short lived since the adhesives frequently lose their effectiveness through contact with the users hands or after a few contacts with the cleaning solution or solvents impregnated in the tissues. Additionally, the bag itself is not a desirable container since it loses its shape and assumes an unpleasant appearance as the products are consumed. The loss in bag shape further impedes proper use and sealing of the adhesive flaps. Consequently, the use of such bags has generally been confined to use as only a single tissue container or to use with a very small number of tissues in a portable or purse size package.

SUMMARY OF THE INVENTION

The subject invention overcomes the above-discussed problems and provides a resealable container assembly which is particularly suited for efficiently and effectively holding and dispensing moist or damp products such as wet tissues. According to the subject invention, the container assembly comprises a first container of bag-like form constructed of a liquid impervious flexible sheet material with the moist products sealed therein. The bag-like container has a weakened tear line encircling a first predetermined area on a first side of the bag to permit selective removal of the predetermined area to define a discharge opening for removing moist products from the interior of the bag-like container. An adhesively coated removable flap member is adhered to the bag-like container in overlying and adhered relationship to the predetermined area such that pulling the flap from the bag-like container tears the predetermined area therefrom to open the discharge opening. A second container of box-like form is constructed of relatively rigid sheet material and encloses the bag-like container. The box-like container has a first wall closely overlying the first predetermined area of the bag-like container. The first wall includes a weakened tear line which encircles a second predetermined area thereof which is in overlying relationship and at least substantially as large as the first predetermined area in the side of the bag-like container. A relatively rigid cover is pivoted relative to the first wall and overlies the second predetermined area. This cover is bonded to the second predetermined area of the first wall such that pivoting of the cover to an open position causes the second predetermined area to be torn from the first wall to provide access to the first predetermined area of the bag-like container.

when the pivoted cover is moved to a closed position, the portion of the first wall which was torn from within the weakened tear line and defined the second predetermined area is moved to its closed position back within the first wall in the nature of a plug member. Thus, the container can be repeatedly opened and closed to a relatively airtight condition without relying on pressure sensitive adhesive flaps or the like. The actual covering and closing is performed by the outer relatively rigid container and its pivoted cover and plug-like closure member.

Preferably, the inner container of bag-like form is bonded at least at spaced positions to the underside of the first wall. The bonding is desirably located outwardly of the second predetermined area to maintain the bag-like container properly in alignment with the second predetermined area so as to allow ready access to the first predetermined area for removal of the adhesively coated flap member and the first predetermined area to open the bag-like discharge opening.

In accordance with a further aspect of the invention, the outer or second container of box-like form is preferably formed from a paperboard material having a surface treatment of a plastic film coating or the like to impede the flow of air and moisture therethrough. Additionally, it is highly desirable if the first wall be formed so as to have a somewhat convex shape extending outwardly toward the cover such that the peripheral edge of the second predetermined area tends to engage the inner side of the cover in somewhat of a line contact so as to facilitate engagement with the plug-like seal portion when it is moved to a closed position.

In accordance with a still more limited aspect of the invention, the cover member is preferably bonded to the first wall at a location well within the second predetermined area so that when the second predetermined area is removed from the first wall, its peripheral edge is free and flexible relative to a cover to improve the sealing between the removed predetermined area portion and the first wall when it is moved to a closed position.

As can be seen from the foregoing, a primary object of the invention is the provision of a container assembly which can be formed using standard sheet materials and well known conventional bag and box forming techniques.

A still further object of the invention is the provision of a resealable type container which is especially suited for use in storing and dispensing wet or damp material and which can be resealed without relying on pressure sensitive adhesives or the like.

A still further object is the provision of a container assembly of the general type described which is of pleasing appearance and which retains its shape throughout an extended period of use.

A further object of the invention is the provision of a container assembly of the general type described which can be manufactured relatively inexpensively in a variety of shapes and sizes.

BRIEF DESCRIPTION OF THE DRAWINGS

The above and other objects and advantages will become apparent from the following description when read in conjunction with the accompanying drawings wherein.

DETAILED DESCRIPTION OF THE PREFERRED EMBODIMENT

Figure 1:
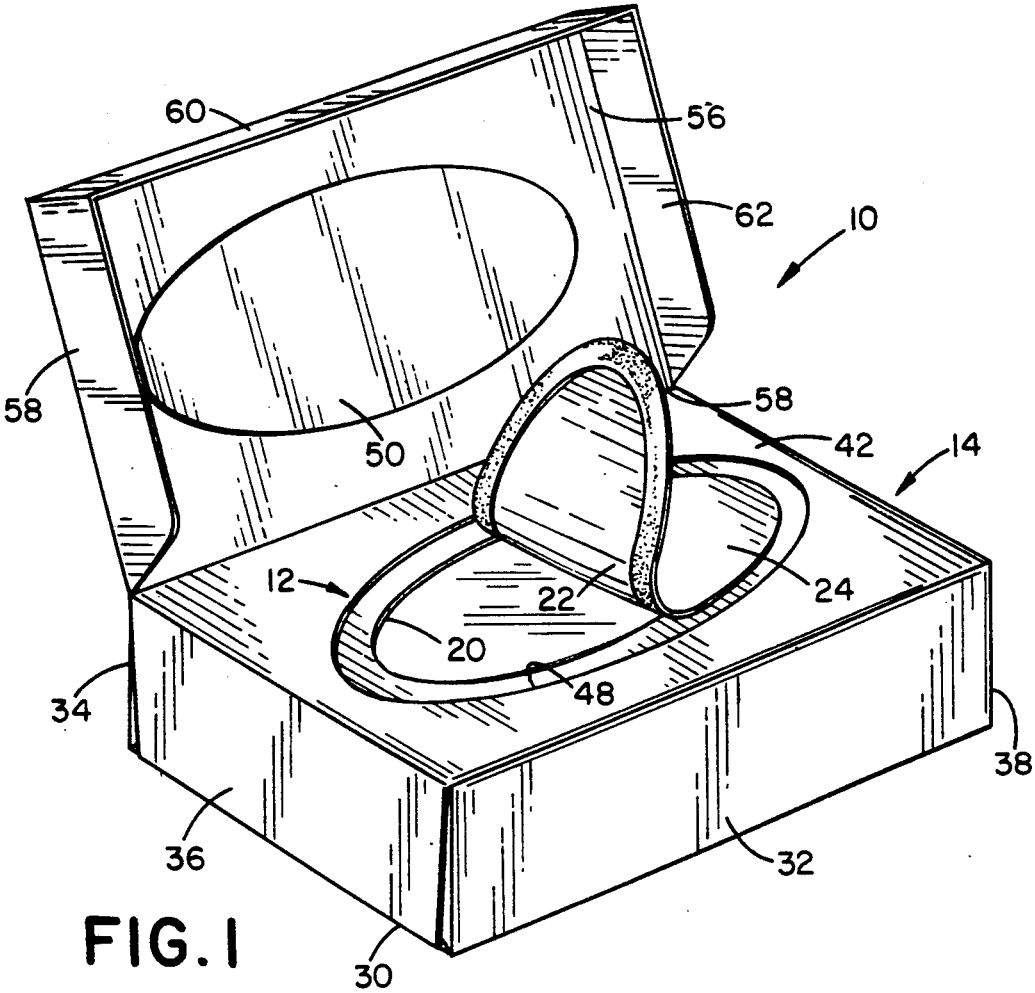
FIG. 1 is a pictorial view of a resealable dispensing box assembly formed in accordance with the preferred embodiment of the invention (the FIG. 1 showing illustrates the box in a partially opened condition)

Referring more particularly to the drawings wherein the showings are for the purpose of illustrating a preferred embodiment of the invention only, and not for purposes of limiting same, FIG. 1 shows the overall arrangement of a resealable container assembly 10 which comprises a first, inner, bag-like container 12 container in an outer, more rigid box-like container 14. The inner bag-like container 12 is of the form and construction generally illustrated in FIG. 7. As shown therein, the bag-like container is formed from a resilient, flexible sheet material which is impervious to liquid. Many different types of sheet material could be used but, in the subject embodiment, the material is preferably a heat sealable, metallized flexible film which is enclosed about a stack of moist or wet tissues and hermetically heat sealed both longitudinally and transversely of the ends as shown at 16. In the preferred embodiment, film marketed under the MYLAR trademark is advantageously used, although other types and styles of film could be satisfactorily employed. MYLAR is a trademark of E.I. DuPont de Nemours and Company for a flexible film product for packaging purposes.

Figure 7:
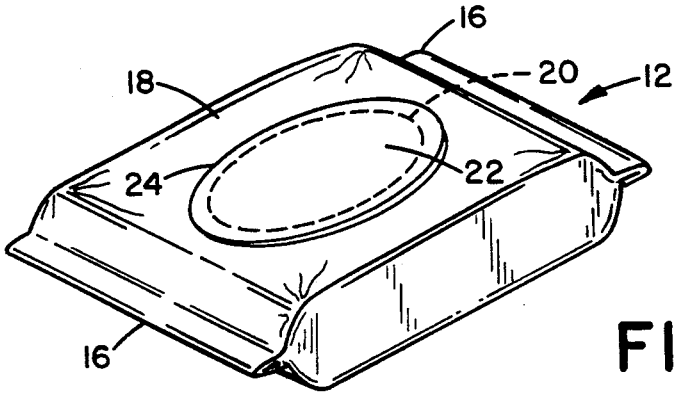

A first side 18 of the bag-like container 12 is provided with a score or tear line 20 which encircles a predetermined first area 22 which is sized so as to provide an access opening for removing the moist tissues from the bag or container 12. In its original packaged condition, the score line or tear line 20 is sealed and prevented from inadvertently tearing from the side 18 by an overlying oval piece of plastic film material 24 that is adhesively bonded to the bag and sized so as to at least slightly overlap and extend beyond the tear line 20 as illustrated in FIG. 7. As shown therein, both the first determined area 22 and the overlying plastic adhesively bonded sheet 24 preferably have a generally elliptical shape and are sized so as to provide an adequate opening for the suitable removal of the wet tissues from within the bag-like container 12.

As can be appreciated, when it is desired to open the bag-like container 12, grasping of the plastic sheet 24 and removing it from the side 18 causes it to tear out the area 22 along the predetermined tear or score line 20.

Figure 2:
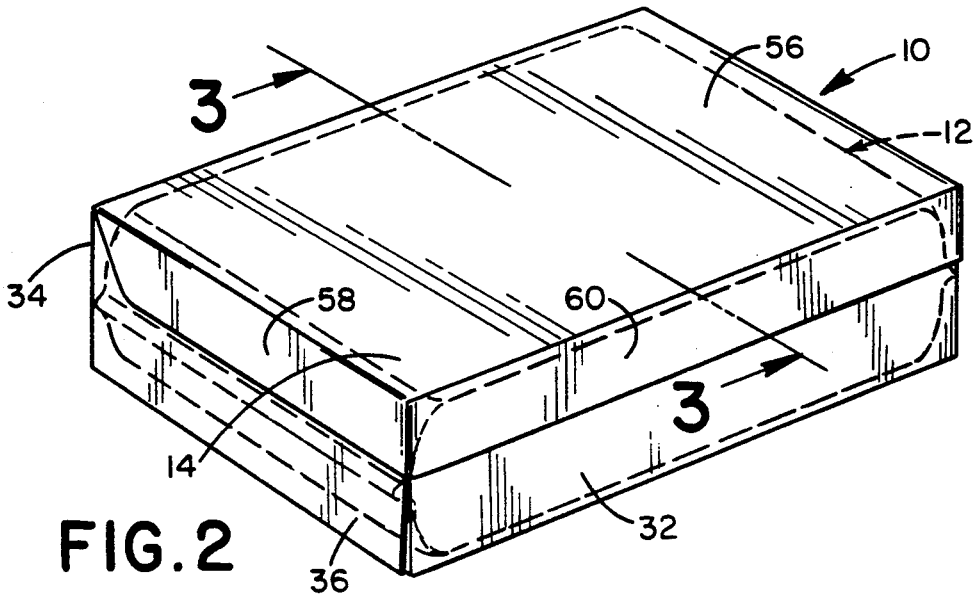
FIG. 2 is a pictorial view similar to FIG. 1 but showing the container assembly in its original closed position.
Figure 3:
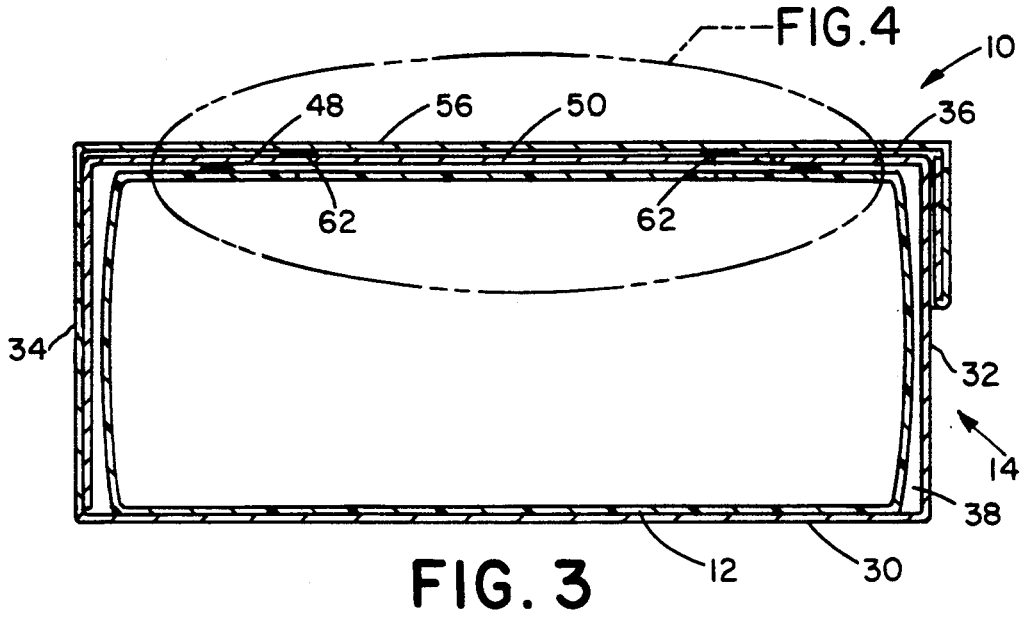
FIG. 3 is a cross-sectional view taken on line 3—3 of FIG. 2.

Referring again to FIG. 1 as well as FIGS. 2 and 3, it will be seen that the bag-like container 12 is suitably enclosed and protected by the relatively rigid outer box-like container 14. Preferably, the outer box-like container 14 is sized so as to closely and relatively snugly contain the bag-like container 12 as illustrated in dotted lines in FIG. 2 and as more clearly shown in the cross-sectional view of FIG. 3.

Although the box-like container 14 could have a variety of shapes and configurations and be formed from many different materials, it is preferably of generally rectangular shape and is formed from a suitable cardboard or paperboard material which is relatively rigid and stiff. Additionally, it is preferable that the paperboard material be treated through suitable conventional surface treatments or coatings so as to have a relatively high degree of imperviousness to both gas and liquid. For example, a surface treatment such as a plastic film coating could be used if desired.

Figure 4:
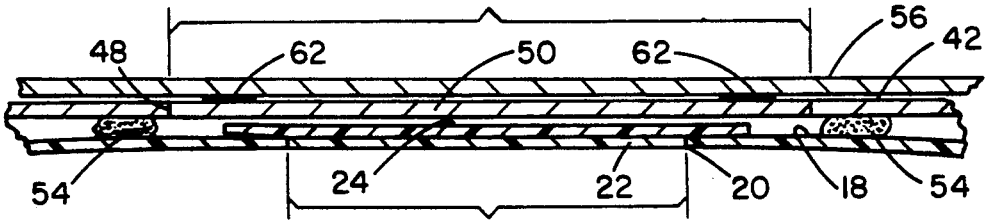
FIG. 4 is a greatly enlarged cross-sectional view of the circled area of FIG. 3.

Although the preferred construction of box-like container 14 will subsequently be described in some detail, for the present it is sufficient to note that it broadly includes a bottom wall 30 and upwardly extending side walls 32 and 34 with a transversely extending first top or upper wall 42. The ends of the walls 32 and 34 are joined by end walls 36 and 38 as illustrated. In the subject embodiment, the top first wall 42 is provided with a weakened score or tear line 48 which extends about a second predetermined area 50 (see FIG. 6) that is preferably sized and shaped to lie outside of the oval plastic sheet 22 and the tear line 20 of bag 12. As generally illustrated in FIG. 4, the tear line 48 is closely adjacent but laterally outward of the subjacent tear line 20. In addition, if desired, the outer container 14 can be bonded to the container 12 at locations such as 54 to maintain alignment between the respective access openings (see FIGS. 4 and 5).

The outer box-like container 14 further includes an integrally connected overlying cover or lid member 56 which is pivotally joined along one longitudinal edge 58 of the top 42. The cover or lid 56 is sized and shaped so as to correspond to the size and shape of the first top wall 42. Additionally, the cover 56 preferably also includes a downwardly extending peripheral flange or rim portion defined by the three separate downward extending sections 58, 60, and 62. These rims or edges are sized so as to closely engage with the upper end of the box container about the wall 42. FIG. 2 illustrates the cover member 56 in a closed position.

Figure 5:
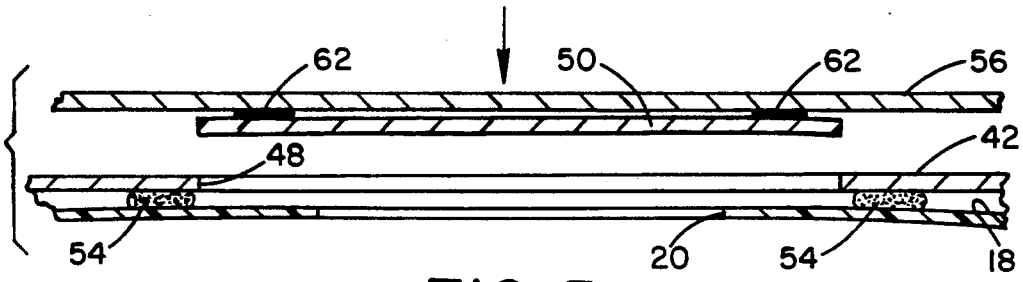
FIG. 5 is a view similar to FIG. 4 but showing the assembly after it has been opened and while the cover member is in the process of being moved to a closed position.

During initial assembly of the container to the shape and closed condition of FIG. 2, the cover 56 is actually bonded to the predetermined area 50 by suitable adhesive at locations within the confines of the tear line 48. This is shown in FIGS. 3, 4, and 5 with the points identified by the reference numeral 62. As there shown, the adhesive at points 62 is preferably located inwardly at least a short distance from the tear line 48. Thus, when the cover member 56 is first opened from the FIG. 2 position to the FIG. 1 position, the predetermined area 50 is torn or forcibly removed from the wall 42 and thereafter remains fixed to the underside of cover 56. This is illustrated in FIGS. 1 and 5.

Because the box-like container 14 is in the assembled condition with the cover 56 actually bonded to area 50, when cover 56 is opened, area portion 50 is precisely positioned for subsequent movement to a closed position. Specifically, FIGS. 4 and 5 show the cover in an original closed, sealed position and in a subsequent open but ready to close position respectively. Note should be taken of the location of the adhesive 62 which allows the peripheral edge of the removed portion 50 to deflect slightly downward with the force of the tearing open operation. Thus, when the container cover 56 is moved back to a closed position, the downwardly extending peripheral edges enter into the opening from which portion 50 was removed. This tends to provide a plug type seal which is perfectly located and aligned with the opening from which it was removed.

After the cover 56 is moved to the open position shown in FIG. 1, the inner bag-like member can be opened by removing the overlying plastic layer 24 which is adhesively bonded to the first predetermined area 22. This layer is shown partially removed in FIG. 1.

Although it would be possible to reinstall the adhesively bonded layer 24 to a closed position from which it was removed, it would normally be discarded. The entire resealing of the package would then be accomplished with reclosing of the cover 56 so as to reinstall the predetermined plug-like area 50 into the opening in the top wall 42.

A closure of the general type described above for closing the opening defined by area 50 can be used at any time without loss of effectiveness. This is in direct contradistinction to an adhesively bonded cover which often losses its effectiveness after a few uses or upon contact with the liquids in the wet tissues.

Figure 6:
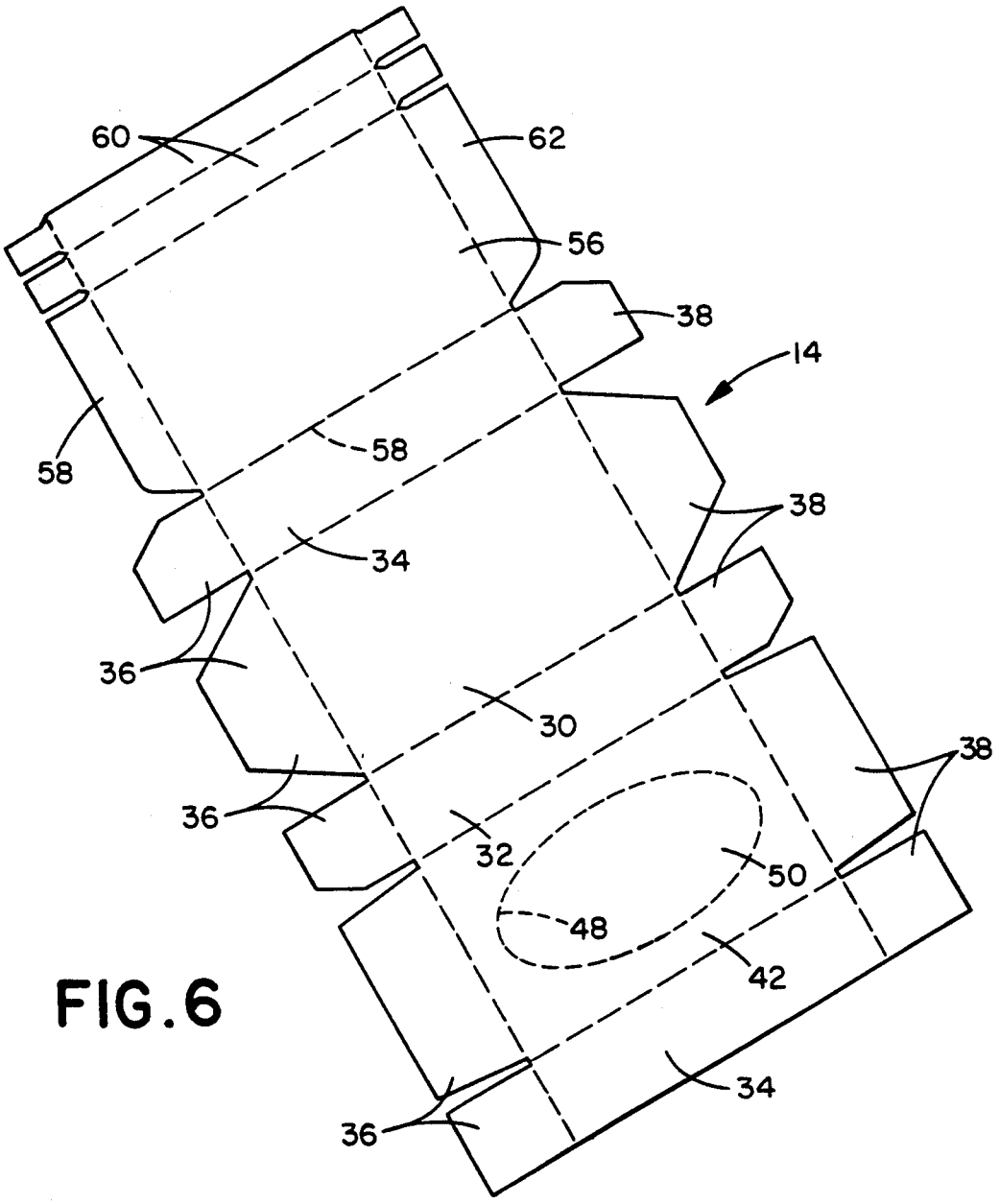
FIG. 6 is a layout showing the form of the blank used for forming the rigid outer container of the assembly of FIG. 1; and, FIG. 7 is a pictorial view showing the inner flexible bag container of the assembly of FIG. 1.

Many different types of outer box-like members could be used, but the preferred embodiment shown contemplates use of a conventional folded sheet construction, a layout of which is illustrated in FIG. 6. The elements of FIG. 6 which form the various components previously identified have been identified with the same numerals so that the assembly of the outer box from the FIG. 6 blank can be readily visualized and understood. In this regard, it should be noted that the various components are folded along the dashed lines and the tab portions identified with the numerals 36 and 38 are suitably bonded together to form the ends 36 and 38. Also, it will be noted that the layout of FIG. 6 includes two side wall panels designated by numeral 34. When the container is properly folded, these two panels are disposed in face to face relation as shown in FIG. 3 so as to define side wall 34. Similarly, the sections 58, 60, and 62 are suitably bent from the plane of the sheet to form the peripheral edges about the cover member portion 56, and these are likewise adhesively joined at the end tabs on the sections 60.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. A resealable dispensing container assembly for moist products comprising:

a first container of bag-like form constructed of liquid impervious flexible sheet material with the moist products sealed therein, the bag-like container having a weakened tear line encircling a first predetermined area on a first side thereof to permit selective removal of the predetermined area to define a discharge opening for removing moist products from the interior of the bag-like container, an adhesively coated removable flap member adhered to the bag-like container in overlying and adhered relationship to the predetermined area such that pulling the flap from the bag-like container tears the first predetermined area therefrom to open the discharge opening;

a second container of box-like form constructed of relatively rigid sheet material and enclosing the bag-like container, the box-like container having a first wall closely overlying the first predetermined area of the bag-like container, the first wall having a weakened tear line encircling a second predetermined area thereof which overlies and is at least substantially as large as the first predetermined area in the side of the bag-like container, a relatively rigid cover pivoted relative to the first wall and overlying said second predetermined area, said cover being bonded to the second predetermined area of the first wall such that pivoting of the cover causes the second predetermined area to be torn from the first wall to provide access to the first predetermined area of the bag-like container.

2. A resealable dispensing container assembly as defined in claim 1 wherein said box-like container is constructed from folded paperboard and the cover is an integral portion thereof pivoted along one side of the first wall.

3. A resealable dispensing container assembly as defined in claim 2 wherein the cover includes a marginal edge which extends downwardly to encircle about the first wall when the cover is pivoted into engagement with the first wall.

4. A resealable dispensing container assembly as defined in claim 1 wherein said first wall is adhered to the first side of the bag-like container at least at spaced points outside of the first predetermined area to prevent shifting of the first predetermined area relative to the second predetermined area.

5. A resealable dispensing container assembly as defined in claim 1 wherein the bag-like container is closely confined in the box-like container and wherein the first wall has a slightly convex configuration.

6. A resealable dispensing container assembly as defined in claim 1 wherein the first wall of the box-like container is of rectangular configuration with the cover being generally of the same size and shape.

7. A resealable dispensing container assembly as defined in claim 6 wherein the cover is pivotally connected adjacent an edge of the first wall and includes marginal peripheral edges which extend downwardly and encircle the first wall when the cover is pivoted into engagement with the first wall.

* * * * *